US006015063A

United States Patent [19]

Poliquin

[11] Patent Number: 6,015,063

[45] Date of Patent: Jan. 18, 2000

[54] TRASH CAN VENT SYSTEM

[76] Inventor: Darrell A. Poliquin, 18698 Garfield, Redford, Mich. 48240

[21] Appl. No.: 09/177,239

[22] Filed: Oct. 22, 1998

[51] Int. Cl.[7] ..... B65D 67/04

[52] U.S. Cl. ..... 220/495.04; 220/908.1

[58] Field of Search ..... 220/495.04, 495.06, 220/908.1, 366.1

[56] References Cited

U.S. PATENT DOCUMENTS

| | | | |
|---|---|---|---|
| 4,294,379 | 10/1981 | Bard | 220/495.04 |
| 4,765,579 | 8/1988 | Robbins, III et al. | 220/495.04 |
| 5,031,796 | 7/1991 | Schafer et al. | 220/571 |
| 5,090,585 | 2/1992 | Power | 220/404 |
| 5,265,755 | 11/1993 | McArthur, Jr. et al. | 220/601 |
| 5,375,732 | 12/1994 | Bowers et al. | 220/404 |
| 5,388,717 | 2/1995 | LeVasseur | 220/404 |
| 5,492,241 | 2/1996 | Barnett et al. | 220/404 |

*Primary Examiner*—Joseph M. Moy
*Attorney, Agent, or Firm*—Joseph N. Breaux

[57] ABSTRACT

A trash can vent system that is securable to a trash can and that includes a vent channel positionable along the interior sidewall of the trash can to prevent the trash can liner from forming a vacuum seal with the interior trash can sidewalls. The vent channel member preferably has a number of vent openings formed therethrough in connection between a vent channel and the trash can liner facing side of the vent channel member and is adjustable in length.

4 Claims, 3 Drawing Sheets

TRASH CAN VENT SYSTEM

TECHNICAL FIELD

The present invention relates to trash cans and the like and more particularly to a trash can vent system including at least one vent structure assemblies including an elongated vent channel member and an edge securing cap formed at one end of the elongated vent channel member; the vent channel member being open along a side thereof and defining a vent channel along the length thereof; the edge securing cap including a right angled corner lip extending outwardly from a cap top having the right angled open side oriented toward the open side of the elongated vent channel member, two can edge receiving slots, each formed between one end of the corner lip and one of the two parallel side edges of the elongated vent channel member, and a cap opening defined through the cap top and in connection with the vent channel of the elongated vent channel member.

BACKGROUND ART

Trash can liners can become stuck within a trash can by a vacuum seal created when the trash can liner contacts the sidewalls of the trash can. When this happens it can be difficult, particularly for weak and infirm individuals, to physically pull the trash can liner out of the trash can. It would be a benefit, therefore, to have a trash can vent system that could be added to a trash can that would provide a vent channel along the interior sidewall of the trash can and, thereby, prevent the trash can liner from forming a vacuum seal. The vent channel system would preferably include a vent channel member having a number of vent openings formed therethrough in connection between a vent channel and the trash can liner facing side of the vent channel member. Because trash cans come in various heights, it would be a further benefit to have a trash can vent system that included a vent channel structure that was easily adjusted in length.

GENERAL SUMMARY DISCUSSION OF INVENTION

It is thus an object of the invention to provide a trash can vent system that is securable to a trash can and that includes a vent channel positionable along the interior sidewall of the trash can to prevent the trash can liner from forming a vacuum seal with the interior trash can sidewalls.

It is a further object of the invention to provide a trash can vent system that includes a vent channel member having a number of vent openings formed therethrough in connection between a vent channel and the trash can liner facing side of the vent channel member.

It is a still further object of the invention to provide a trash can vent system that includes a vent channel structure that was easily adjusted in length.

It is a still further object of the invention to provide a trash can vent system that includes a vent structure assembly including an elongated vent channel member and an edge securing cap formed at one end of the elongated vent channel member; the vent channel member being open along a side thereof and defining a vent channel along the length thereof; the edge securing cap including a right angled corner lip extending outwardly from a cap top having the right angled open side oriented toward the open side of the elongated vent channel member, two can edge receiving slots, each formed between one end of the corner lip and one of the two parallel side edges of the elongated vent channel member, and a cap opening defined through the cap top and in connection with the vent channel of the elongated vent channel member.

It is a still further object of the invention to provide a trash can vent system that accomplishes some or all of the above objects in combination.

Accordingly, a trash can vent system is provided. The trash can vent system includes a vent structure assembly including an elongated vent channel member and an edge securing cap formed at one end of the elongated vent channel member; the vent channel member being open along a side thereof and defining a vent channel along the length thereof; the edge securing cap including a right angled corner lip extending outwardly from a cap top having the right angled open side oriented toward the open side of the elongated vent channel member, two can edge receiving slots, each formed between one end of the corner lip and one of the two parallel side edges of the elongated vent channel member, and a cap opening defined through the cap top and in connection with the vent channel of the elongated vent channel member. In a preferred embodiment, the vent channel member has a number of vent openings formed therethrough in connection between a vent channel and the trash can liner facing side of the vent channel member. In another preferred embodiment, the vent channel member includes a number of spaced separation score grooves provided across the vent channel member to allow a user to easily shorten the vent channel member to fit into a trash can by snapping off an end section of the vent channel member.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
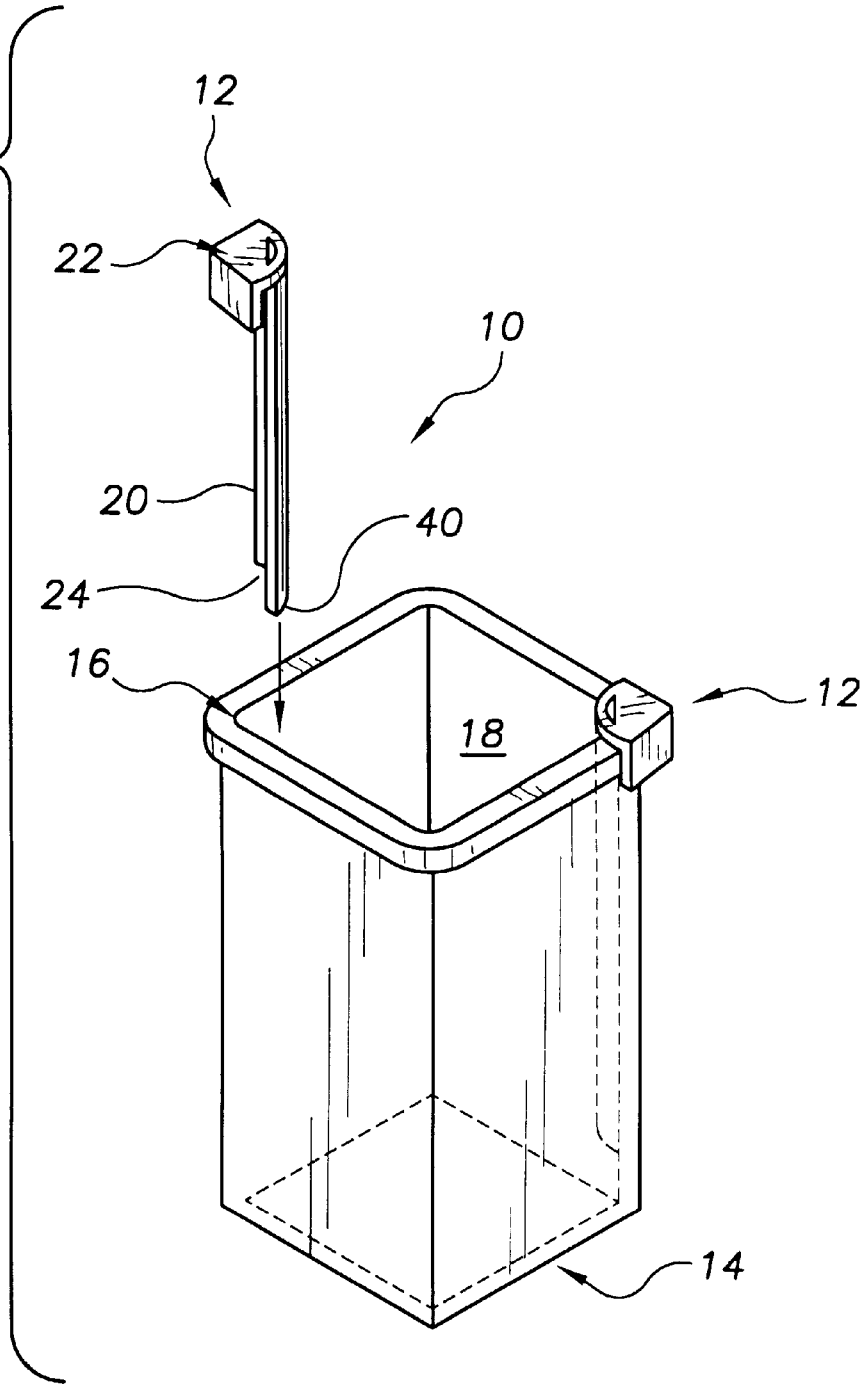
FIG. 1 is a perspective view showing an exemplary embodiment of the trash can vent system of the present invention with one of the two identical, integrally molded vent structure assemblies installed in a representative trash can and the other vent structure assembly positioned above the corner of the trash can opening prior to installation; each vent structure assembly including an elongated vent channel member and an edge securing cap formed at one end of the elongated vent channel member.

FIG. 1 shows an exemplary embodiment of the trash can vent system of the present invention, generally designated

10, with one of the two identical, integrally molded vent structure assemblies, generally designated 12, installed in a representative trash can 14 and the other vent structure assembly 12 positioned above the corner edge 16 of the trash can opening 18 prior to installation. Each vent structure assembly 12 is of single-piece, molded plastic construction and includes an elongated vent channel member 20 and an edge securing cap 22 formed at one end of the elongated vent channel member 20.

Figure 2:
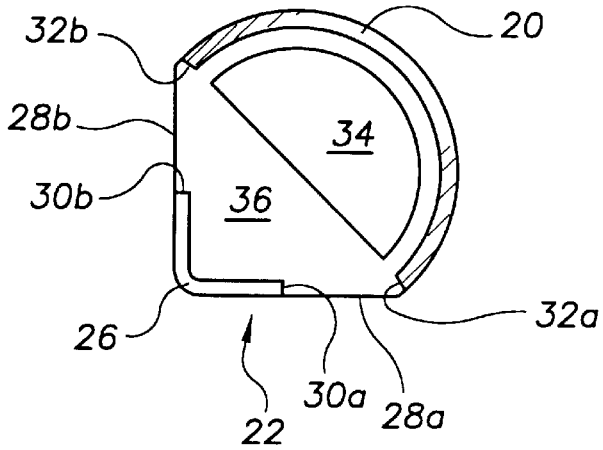
FIG. 2 is an bottom end plan view of one of the two identical exemplary vent structure assemblies of FIG. 1 showing the vent channel formed by the elongated vent channel member; and the corner lip, the two can edge receiving slots, each formed between the corner lip and one of the two parallel side edges of the elongated vent channel member, and the cap opening of the edge securing cap.

Vent structure assembly 12 has a vent channel 24 formed and defined along the length of elongated vent channel member 20. Referring to FIG. 2, edge securing cap 22 includes a right angled corner lip 26; two can edge receiving slots 28*a*,28*b*, each formed between the ends 30*a*,30*b*, respectively, of corner lip 22 and one of the two parallel side edges 32*a*,32*b* of elongated vent channel member 20; and a half-circular shaped cap opening 34 formed through a top 36 of edge securing cap 22 and in connection with vent channel 24 (FIG. 1). With general reference to FIGS. 1 and 2, in use, the bottom edge 40 (FIG. 1) of elongated vent channel member 20 is inserted down through trash can opening 18 and corner edge 16 of trash can opening 18 is positioned within the two can edge receiving slots 28*a*,28*b* of edge securing cap 22. Once vent channel member 20 is in place, vent channel 24 and half-circular cap opening 34 provide an airflow passage that prevents a trash bag inserted within trash can 14 from forming a vacuum seal as discussed herein before.

Figure 3:
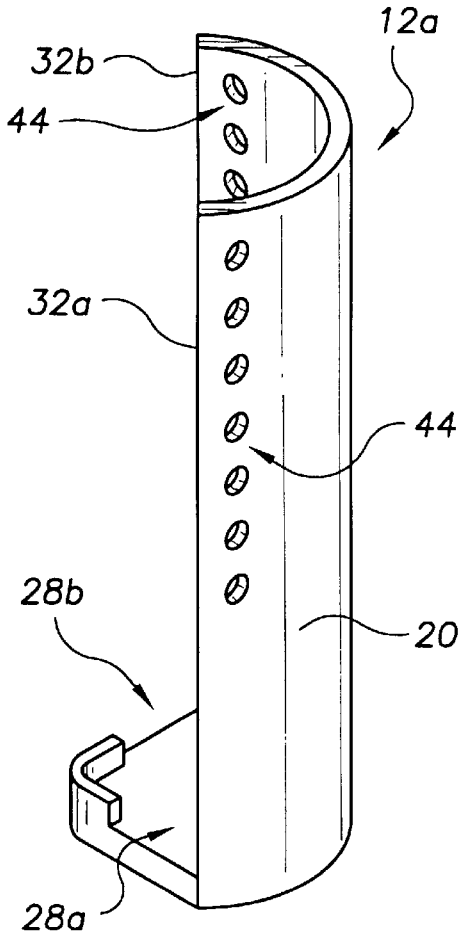
FIG. 3 is a perspective view of a second exemplary vent structure assembly having a row of vent apertures provided along each of the two parallel side edges of the vent channel member.

With reference to FIG. 3, a second exemplary vent structure assembly, generally designated 12*a*, is identical to vent structure assembly 12 (FIG. 1) except that a row of vent apertures 44 is provided along each of the two parallel side edges 32*a*,32*b* of vent channel member 20. Vent apertures 44 provide an additional airflow pathway to prevent formation of a vacuum seal between a trash can liner and the interior sidewalls of a trash can 14 (FIG. 1).

Figure 4:
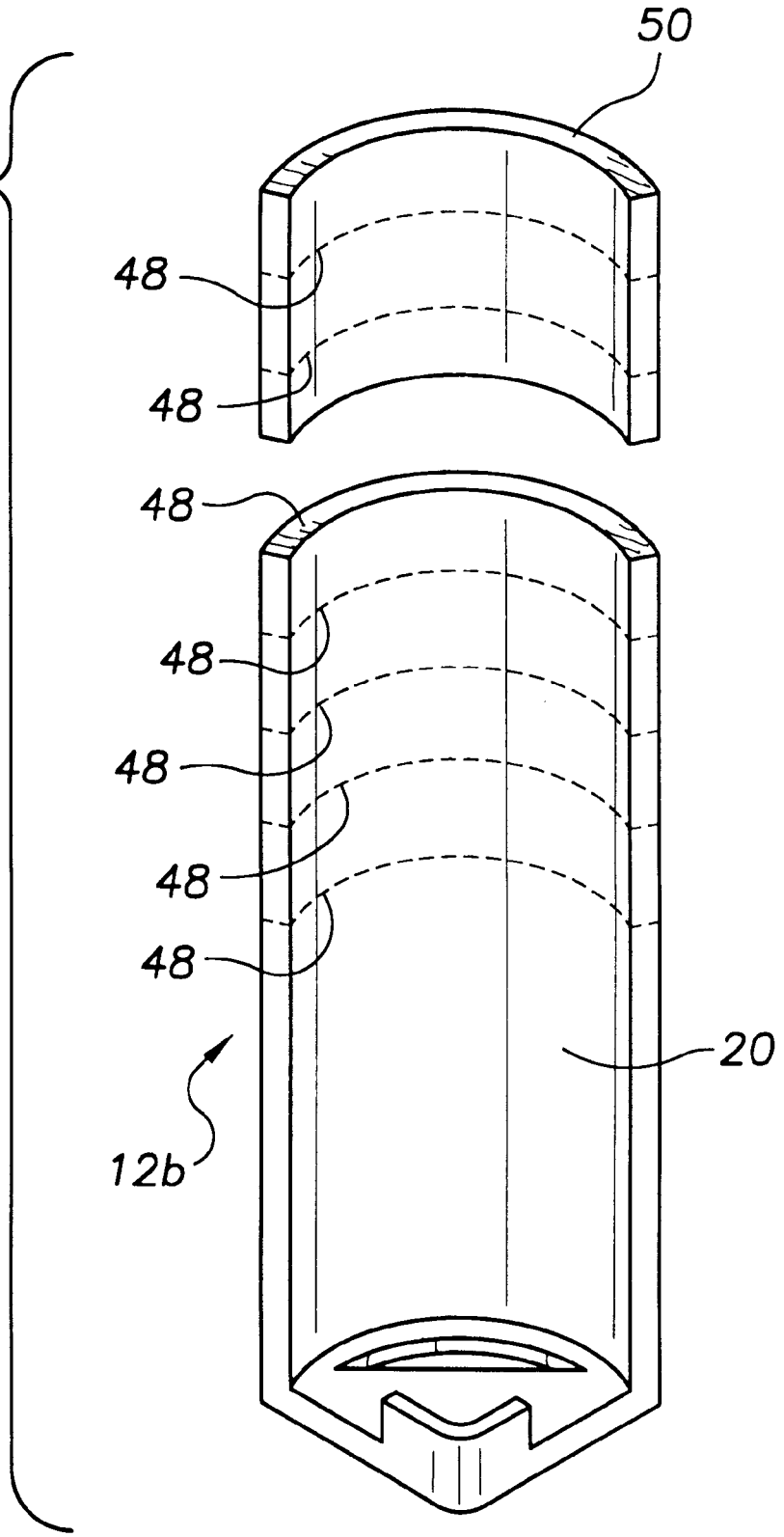
FIG. 4 is a perspective view showing a third exemplary embodiment of the vent structure assembly showing a number of spaced separation score grooves provided across the vent channel member to allow a user to easily shorten the vent channel member to fit into a trash can.

With reference to FIG. 4, a third exemplary vent structure assembly, generally designated 12*b*, is identical to vent structure assembly 12 (FIG. 1) except a number of spaced, separation score grooves 48 are provided across vent channel member 20 to provide convenient break point lines that allow a user to easily shorten vent channel member 20 to fit into a particular trash can 14 (FIG. 1) by snapping off an end section 50 of the required length.

It can be seen from the preceding description that a trash can vent system has been provided that is securable to a trash can and that includes a vent channel positionable along the interior sidewall of the trash can to prevent the trash can liner from forming a vacuum seal with the interior trash can sidewalls; that includes a vent channel member having a number of vent openings formed therethrough in connection between a vent channel and the trash can liner facing side of the vent channel member; that includes a vent channel structure that was easily adjusted in length; and that includes a vent structure assembly including an elongated vent channel member and an edge securing cap formed at one end of the elongated vent channel member; the vent channel member being open along a side thereof and defining a vent channel along the length thereof; the edge securing cap including a right angled corner lip extending outwardly from a cap top having the right angled open side oriented toward the open side of the elongated vent channel member, two can edge receiving slots, each formed between one end of the corner lip and one of the two parallel side edges of the elongated vent channel member, and a cap opening defined through the cap top and in connection with the vent channel of the elongated vent channel member.

It is noted that the embodiment of the trash can vent system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A trash can vent system comprising:

a vent structure assembly including an elongated vent channel member and an edge securing cap formed at one end of said elongated vent channel member;

said vent channel member being open along a side thereof and defining a vent channel along said length thereof;

said edge securing cap including a right angled corner lip extending outwardly from a cap top having said right angled open side oriented toward said open side of said elongated vent channel member, two can edge receiving slots, each formed between one end of said corner lip and one of said two parallel side edges of said elongated vent channel member, and a cap opening defined through said cap top and in connection with said vent channel of said elongated vent channel member.

2. The trash can vent system of claim 1 wherein:

said vent channel member has a number of vent openings formed therethrough in connection between said vent channel and a trash can liner facing side of said vent channel member.

3. The trash can vent system of claim 1 wherein:

said vent apertures are arranged in two rows, one of said two rows of vent apertures provided along each of two parallel side edges of said vent channel member.

4. The trash can vent system of claim 1 wherein:

said vent channel member includes a number of spaced separation score grooves provided across said vent channel member.

* * * * *